US010457069B2

(12) United States Patent
Bradway et al.

(10) Patent No.: US 10,457,069 B2
(45) Date of Patent: Oct. 29, 2019

(54) APPARATUS FOR REPEATABLE STAGING AND HOLDING OBJECTS IN A 3-D PRINTER USING AN ARRAY OF PINS

(71) Applicant: XEROX CORPORATION, Norwalk, CT (US)

(72) Inventors: Jeffrey J Bradway, Rochester, NY (US); Erwin Ruiz, Rochester, NY (US); Paul M Fromm, Rochester, NY (US); Linn C Hoover, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 138 days.

(21) Appl. No.: 15/477,488

(22) Filed: Apr. 3, 2017

(65) Prior Publication Data

US 2018/0281464 A1 Oct. 4, 2018

(51) Int. Cl.

| | |
|---|---|
| ***B41J 11/00*** | (2006.01) |
| ***B41J 3/407*** | (2006.01) |
| ***B41J 11/02*** | (2006.01) |

(52) U.S. Cl.

CPC ..... *B41J 3/4073* (2013.01); *B41J 11/02* (2013.01)

(58) Field of Classification Search

CPC ..... B41J 3/4073; B41J 15/009; B41J 15/10; B41J 11/02; B41J 29/54; H01L 21/68742; B25B 11/00; B23Q 1/035

USPC ..... 269/266, 9; 29/281.5, 281, 281.6, 281.4

See application file for complete search history.

(56) References Cited

U.S. PATENT DOCUMENTS 4,936,560 A * 6/1990 Barozzi ..... B23Q 1/035 269/266

5,941,700 A * 8/1999 Fuchs ..... A61C 13/20 269/266

5,984,293 A * 11/1999 Abrahamson ..... B23Q 1/035 269/236

OTHER PUBLICATIONS

U.S. Appl. No. 15/163,880, filed May 25, 2016, and entitled System for Printing on Three-Dimensional (3D) Objects by Wayne A. Buchar et al.

* cited by examiner

*Primary Examiner* — Monica S Carter
*Assistant Examiner* — Abbie E Quann

(57) ABSTRACT

A universal staging platen for many types of objects in Direct to Object printing has a datum surface which is configured to represent the plane of optimal print head distance. The universal staging platen has an array of small pins protruding from it that conform under spring load to an object placed on the datum surface. Once in a conformed state, an operator can lock the pin position so that the object is precisely positioned for acquisition by a gripper mechanism. An added benefit of locking the pin position is that subsequent copies of the object may be loaded without any additional alignment or setup. The distance the contour pins protrude through the datum surface may be adjusted so that the pin ends are sufficiently far away from the gripper mechanism being used.

7 Claims, 8 Drawing Sheets

APPARATUS FOR REPEATABLE STAGING AND HOLDING OBJECTS IN A 3-D PRINTER USING AN ARRAY OF PINS

CROSS REFERENCE TO RELATED APPLICATIONS

Cross-referenced is commonly assigned U.S. application Ser. No. 15/477,125, filed Apr. 3, 2017, and entitled VACUUM TUBE OBJECT CLAMPING ARRAY WITH CONFORMABLE PADS by Timothy P. Foley et al, US Publication No. 2018-0281316, now allowed; U.S. application Ser. No. 15/477,127, filed Apr. 3, 2017, and entitled APPARATUS FOR HOLDING DURING THREE-DIMENSIONAL (3D) OBJECTS DURING PRINTING THEREON by Jeffrey J. Bradway et al, now U.S. Pat. No. 9,925,726; U.S. Publication No. 2018-0282086, and entitled UNIVERSAL PART GRIPPER WITH CONFORMABLE TUBE GRIPPERS by Linn C. Hoover et al; U.S. Publication No. 2018-0281305 and entitled SPRING LOADED SUCTION CUP ARRAY GRIPPER by Paul M. Fromm et al, now U.S. Pat. No. 10,279,456; U.S. Application Ser. No. 62/480,563, filed Apr. 3, 2017, and entitled UNIVERSAL OBJECT HOLDER FOR 3-D PRINTING USING A CONFORMABLE GRIPPER BALL by Erwin Ruiz et al, expired and refiled as Ser. No. 15/626,200, now issued as U.S. Pat. No. 10,087,020; U.S. Publication No. 2018-0281306, and entitled UNIVERSAL PART GRIPPER USING 3-D PRINTED MOUNTING PLATE by Linn C. Hoover et al; U.S. Publication No. 2018-0281199, and entitled APPARATUS FOR GENERAL OBJECT HOLDING DURING PRINTING USING MULTIPLE CONFORMABLE BALLS by Jeffrey J. Bradway et al; U.S. Pat. No. 9,925,799, issued Mar. 27, 2018, and entitled AIR PRESSURE LOADED MEMBRANE AND PIN ARRAY GRIPPER by Paul M. Fromm et al; and U.S. Pat. No. 10,086,518, issued Oct. 2, 2018, and entitled SPRING LOADED IRIS MECHANISM STACK GRIPPER by Paul M. Fromm et al; all of which are included in their entirety herein by reference.

TECHNICAL FIELD

This disclosure relates generally to a system for printing on three-dimensional (3-D) objects, and more particularly, to an apparatus adapted for general object holding in a non-production environment.

BACKGROUND

Commercial article printing typically occurs during the production of the article. For example, ball skins are printed with patterns or logos prior to the ball being completed and inflated. Consequently, a non-production establishment, such as a distribution site, which customizes products, for example, in region in which potential product customers support multiple professional or collegiate teams, needs to keep an inventory of products bearing the logos of the various teams. Ordering the correct number of products for each different logo to maintain the inventory can be problematic.

One way to address these issues in non-production outlets would be to keep unprinted versions of the products, and print the patterns or logos on them at the distribution site. Adapting known printing techniques, such as two-dimensional (2-D) media printing technology, to apply image content onto 3-D objects would be difficult. Since the surfaces to be printed must be presented to the print heads as relatively flat, 2-D surfaces, the objects have to be maneuvered carefully to present portions of the articles as parallel planes to the print heads.

One Direct to Object printing system that accomplishes this is disclosed in copending and commonly assigned U.S. patent application Ser. No. 15/163,880, filed on May 25, 2016, now U.S. Pat. No. 9,827,784, issued Nov. 28, 2017 and entitled SYSTEM FOR PRINTING ON THREE-DIMENSIONAL (3D) OBJECTS by Wayne A. Buchar et al. This printing system includes a plurality of print heads arranged in a 2-D array, each printhead being configured to eject marking material, a support member positioned to be parallel to a plane formed by the 2-D array of print heads, a member movably mounted to the support member, an actuator operatively connected to the movably mounted member to enable the actuator to move the moveably mounted member along the support member, an object holder configured to mount to the movably mounted member to enable the object holder to pass the array of print heads as the moveably mounted member moves along the support member, and a controller operatively connected to the plurality of print heads and the actuator, the controller being configured to operate the actuator to move the object holder past the array of print heads and to operate the plurality of print heads to eject marking material onto objects held by the object holder as the object holder passes the array of print heads. This application is included herein by reference to the extent necessary to the practice the present disclosure and in its entirety.

A problem with this approach is that Direct to Object digital printers capable of printing on three-dimensional products require a unique part holder for each part to be printed in order to maintain repeatable part placement. The part holders are currently machined metal brackets with dedicated locating and fastening features machined into each holder. This limits the ability of an operator to print onto general objects brought by an end user. Other more general methods for holding objects lack ease of setup for repeated instances of a part.

SUMMARY

In answer to this shortcoming, disclosed is a universal staging platen that facilitates repeatable reloading and rapid acquisition of new parts. The staging platen includes an array of pins for supporting parts for acquisition by a gripper for movement past print heads of a 3-D printer. Once an object is put in place on the staging platen, the pins conform to the shape of the object under preload from either springs or elastic bands. The pins are then locked into place using a clamping plate. The object is then picked up by a gripper and moved into position for printing.

BRIEF DESCRIPTION OF THE DRAWINGS

The foregoing aspects and other features of a printing system that prints images on 3-D objects are explained in the following description, taken in connection with the accompanying drawings.

DETAILED DESCRIPTION

Figure 1:
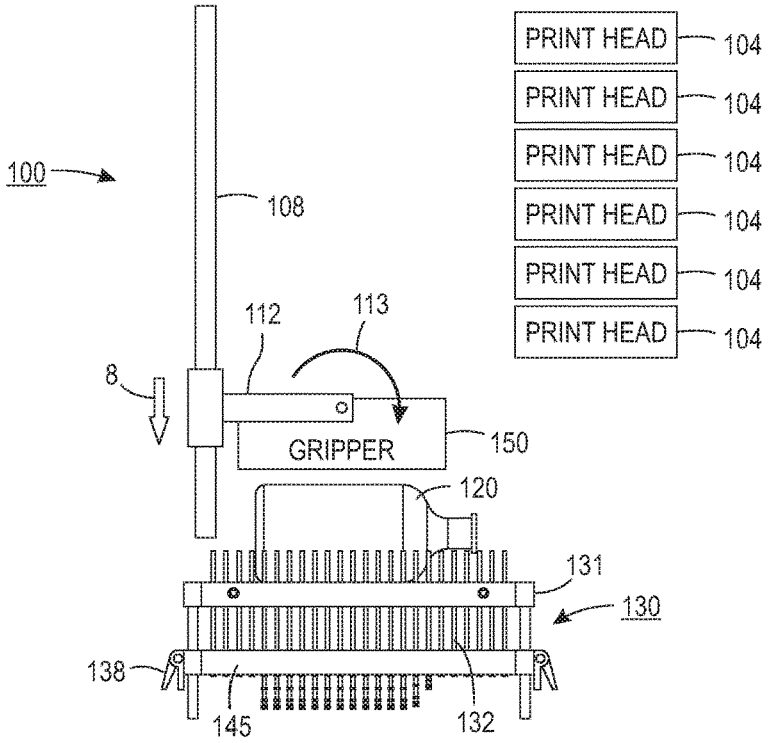
FIG. 1 illustrates an exemplary partial block printing system 100 configured to print on a 3-D object held by an object holder that includes a universal staging platen for supporting objects repeatably in a predetermined plane.

For a general understanding of the present embodiments, reference is made to the drawings. In the drawings, like reference numerals have been used throughout to designate like elements.

FIG. 1 illustrates an exemplary printing system 100 configured to print on a 3-D object. The printing system 100 includes an array of print heads 104, a support member 108, a member 112 movably mounted to the support member 108 to be moved in the direction of arrow 8 in FIG. 1 and arrow 9 in FIG. 2 and a universal object holder 150 configured to pivotally mount to the movably mounted member 112 and adapted to rotate in the direction of arrow 113 to pick up an object. As shown in FIG. 1, the array of print heads 104 is arranged in a two-dimensional array, which in the figure is a 10×1 array, although other array configurations can be used. Each print head is fluidly connected to a supply of marking material (not shown) and is configured to eject marking material received from the supply. Some of the print heads can be connected to the same supply or each print head can be connected to its own supply so each printhead can eject a different marking material.

The support member 108 is positioned to be parallel to a plane formed by the array of print heads and, as shown in the figure, is oriented so one end of the support member 108 is at a higher gravitational potential than the other end of the support member. This orientation enables the printing system 100 to have a smaller footprint than an alternative embodiment that horizontally orients the array of print heads and configures the support member, movably mounted member, and object holder to enable the object holder to pass objects past the horizontally arranged print heads so the print heads can eject marking material downwardly on the objects.

Figure 2:
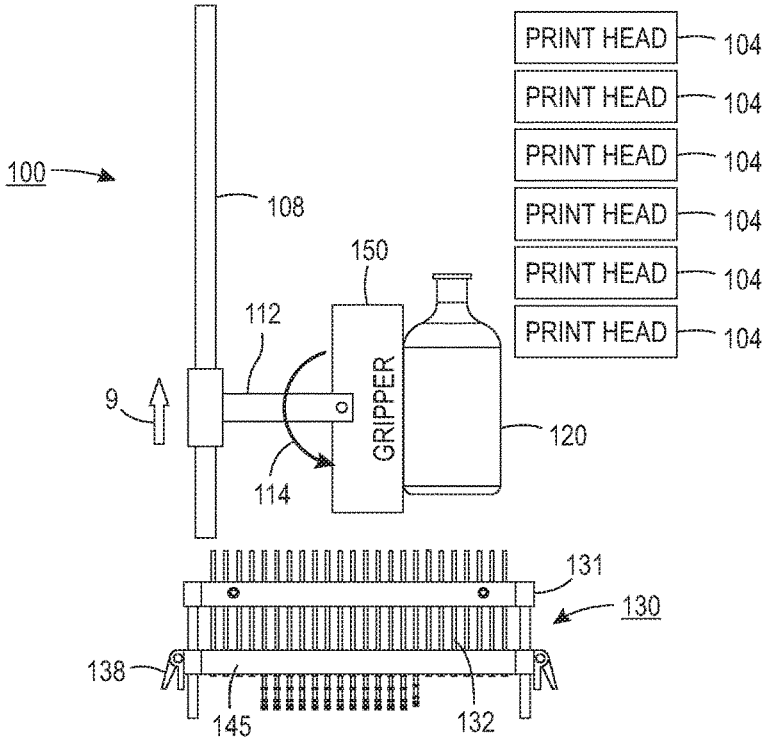
FIG. 2 illustrates the exemplary partial block printing system 100 in FIG. 1 with the an object removed from said universal staging platen and in position to receive another object of the same type.

The member 112 is movably mounted to the support member 108 to enable the member to slide bi-directionally along the support member. In FIG. 1, the object holder 150 has been rotated by member 112 through conventional means into a first position or object acquiring positioned that is parallel to object 120. Object 120 has been positioned onto staging platen 130 for acquisition. In FIG. 2, object 120 has been acquired and member 112 has been rotated in the direction of arrow 114 into a second position and member 112 now moves object 120 along the length dimension of the array of print heads 104 by conventional means, such as, with the use of pulleys and belts or a screw drive.

Figure 3:
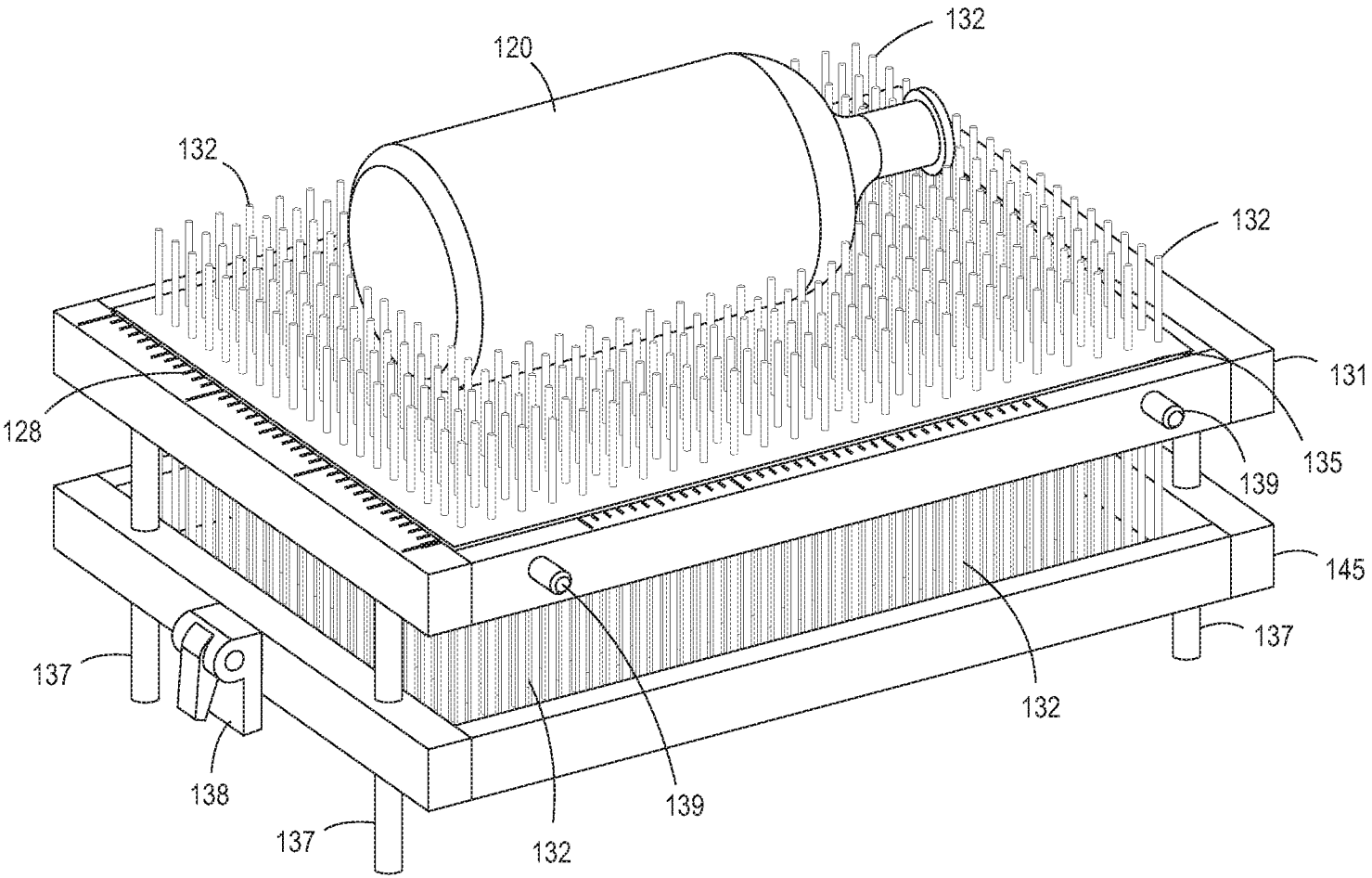
FIG. 3 shows the universal staging platen of FIG. 1 including a high density array of contour pins.

In accordance with the present disclosure, universal staging platen 130 for many types of objects in a Direct to Object printer in FIG. 3 and includes upper support frame 131 positioned on guide pins 137 supporting a datum plate 135 with a high density of pins 132. Datum plate 135 is used to represent the plane of optimal print head distance. The high density of small pins 132 protrude a predetermined distance through datum surface 135 and will conform under spring load to an object placed upon datum surface 135. Toggle clamps 138 and lower guide plate 134 are used to lock pins 132 in position once they are in a conformed state so that object 120 is securely and precisely positioned for acquisition by a gripper mechanism 150 in FIG. 1. The distance contour pins 132 protrude through datum plate 135 is adjustable in order to not interfere with the operation of any type of gripper mechanism 150. Universal staging platen 130 is configured to be inserted into printing system 100 with integration members 139 that could be pins or threaded holes. It is significant that pins 132 are shown in their extended position due to the weight of object 120 even after object 120 had been removed from staging platen 130 and will remain so for additional objects types to be placed onto datum plate 135 without any additional alignment or setup required.

Figure 4:
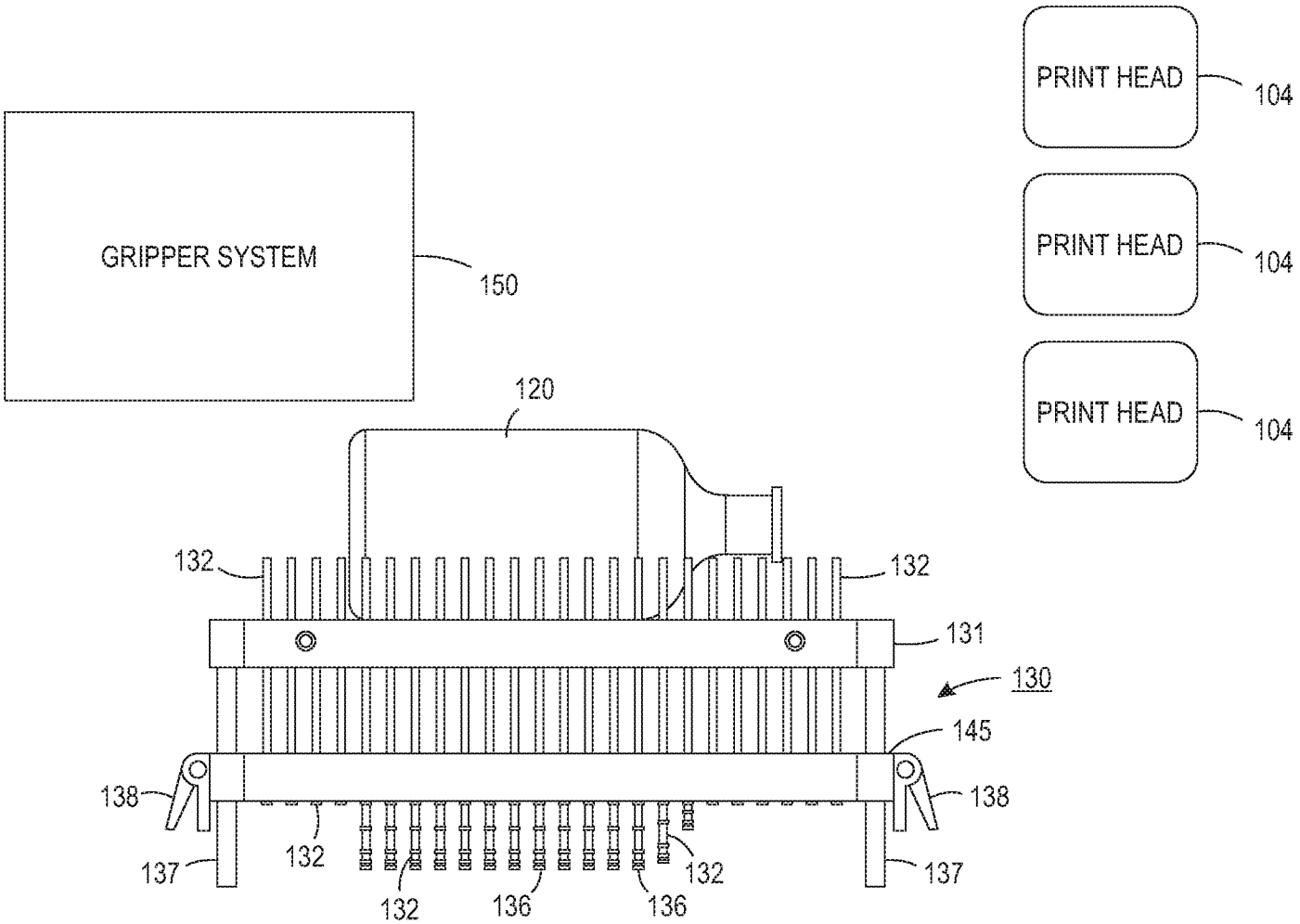
FIG. 4 depicts side view details of the universal staging platen shown in FIG. 3.
Figure 5:
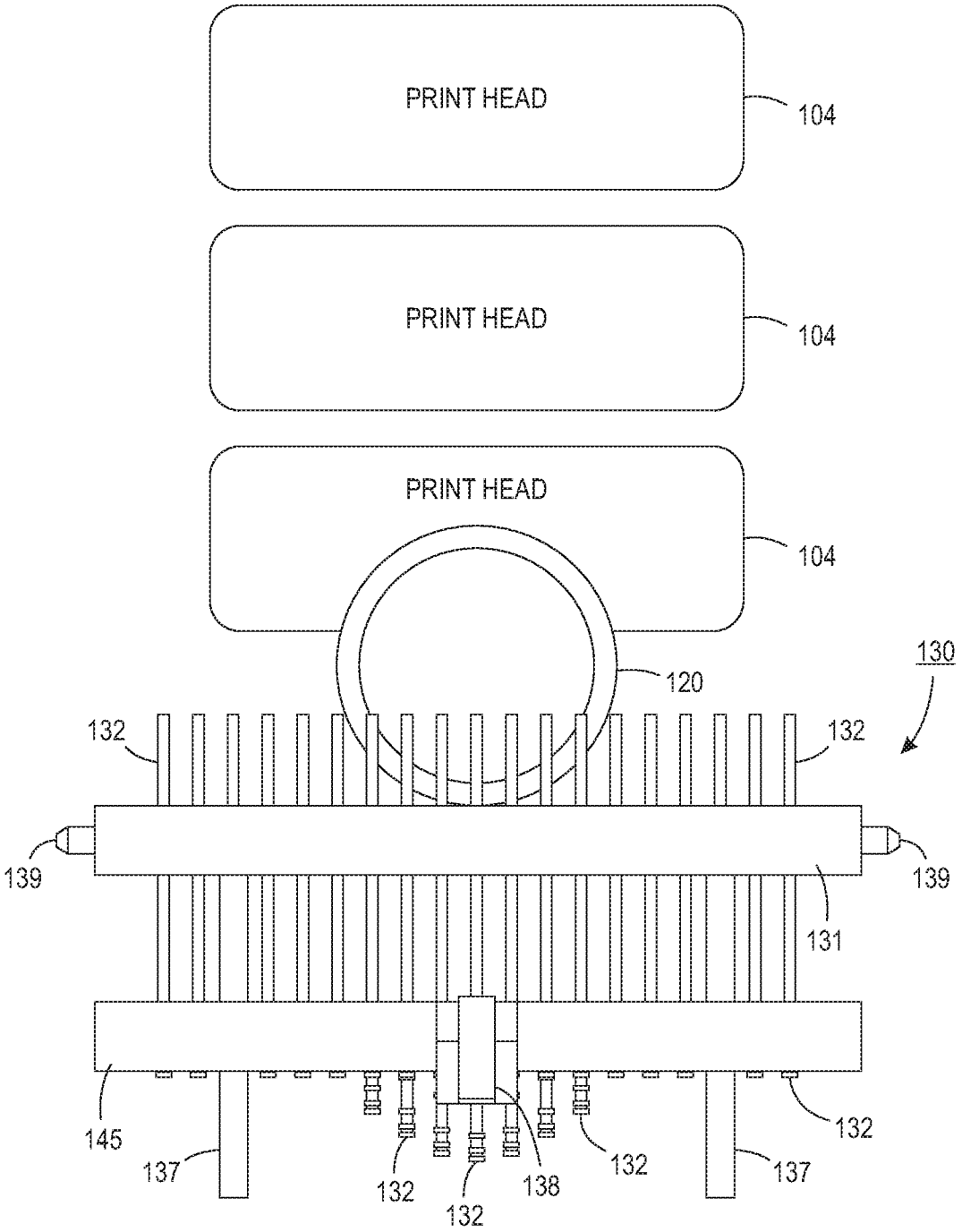
FIG. 5 is an end view of the universal staging platen in FIG. 3.

In FIG. 4, universal staging platen 130 is shown in relation to print heads 104 and gripper 150 with pins 132 at differing heights after placement of object 120 onto datum plate 135 within upper support frame 131. Alignment of object 120 to universal staging platen 130 may be assisted by rule marks 128 on a portion of upper support frame 131. Pins displaced by the body of object 120 have been moved an appreciable distance below upper support frame 131 while pins 132 located beyond the rear of object 120 and at the neck portion of object 120 have not been displaced. Universal staging platen 130 in FIG. 5 shows the displacement of pins 132 by object 120 looking at print heads 104 from the rear of universal staging platen 130.

Figure 6A:
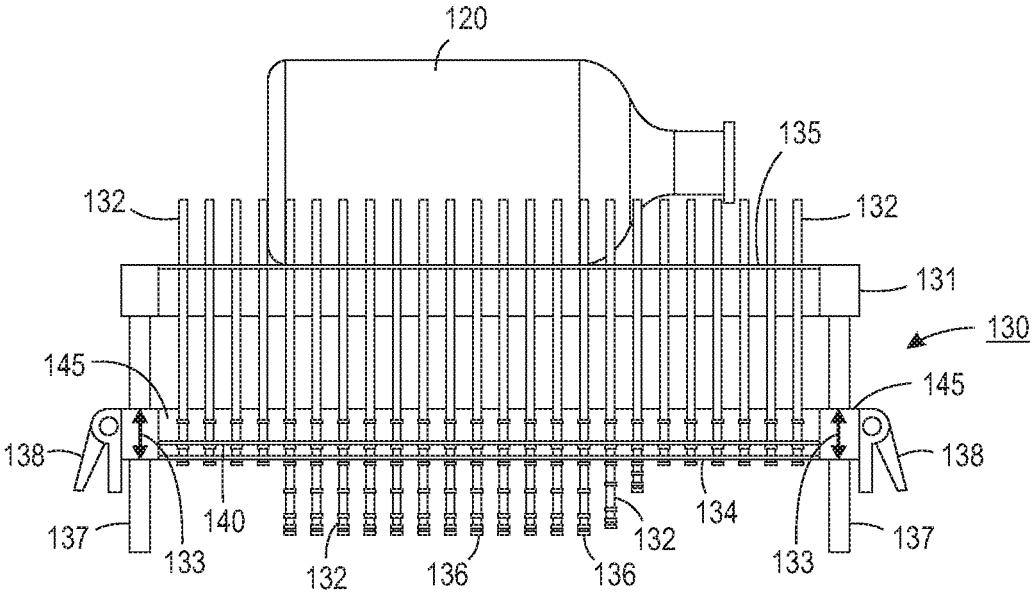
FIGS. 6A and 6B show aspects of pin height adjustment of the pin array in FIG. 5.
Figure 6B:
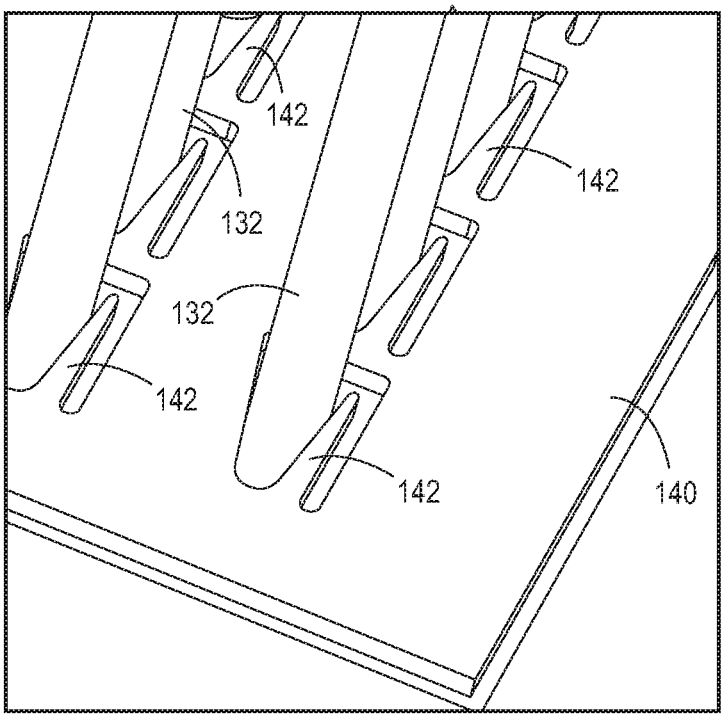

Height adjustment and stabilizing of pins 132 above datum plate 135 are shown in FIGS. 6A and 6B. Contour pins 132 in FIG. 6A are pushed by spring force until their pinheads 136 touch lower guide plate 134. Lower guide plate 134, clamping plate 140 and lower support frame 145 can move with respect to guide pins 137 by releasing toggle clamps 138 and sliding lower support frame 145 in one direction of bidirectional arrow 133. This changes the length of contour pins 132 that protrude through datum plate 135. In this way, pins 132 can be long enough to contour around the outer surface of object 120 without interfering with gripping mechanism 150. Once at the correct height, toggle clamps 138 are engaged which slides clamping plate 140 horizontally with respect to datum plate 135 and lower guide plate 134; laterally with respect to guide pins 137. This applies a clamping force to all pins 132 and to all pin guides 137 and locks universal staging plate 130 in its current, contoured position. Alternatively, a second set of toggle clamps could be used to separately provide clamping force between lower support frame 145 and guide pins 137. Clamping is achieved in FIG. 6B with clamping plate 140 which has multiple compliant fingers 142 that allow clamping plate 140 to locally deflect to apply force to a pin 132 or guide pin 137 without requiring too precise of pin placement for all pin density.

Figure 7:
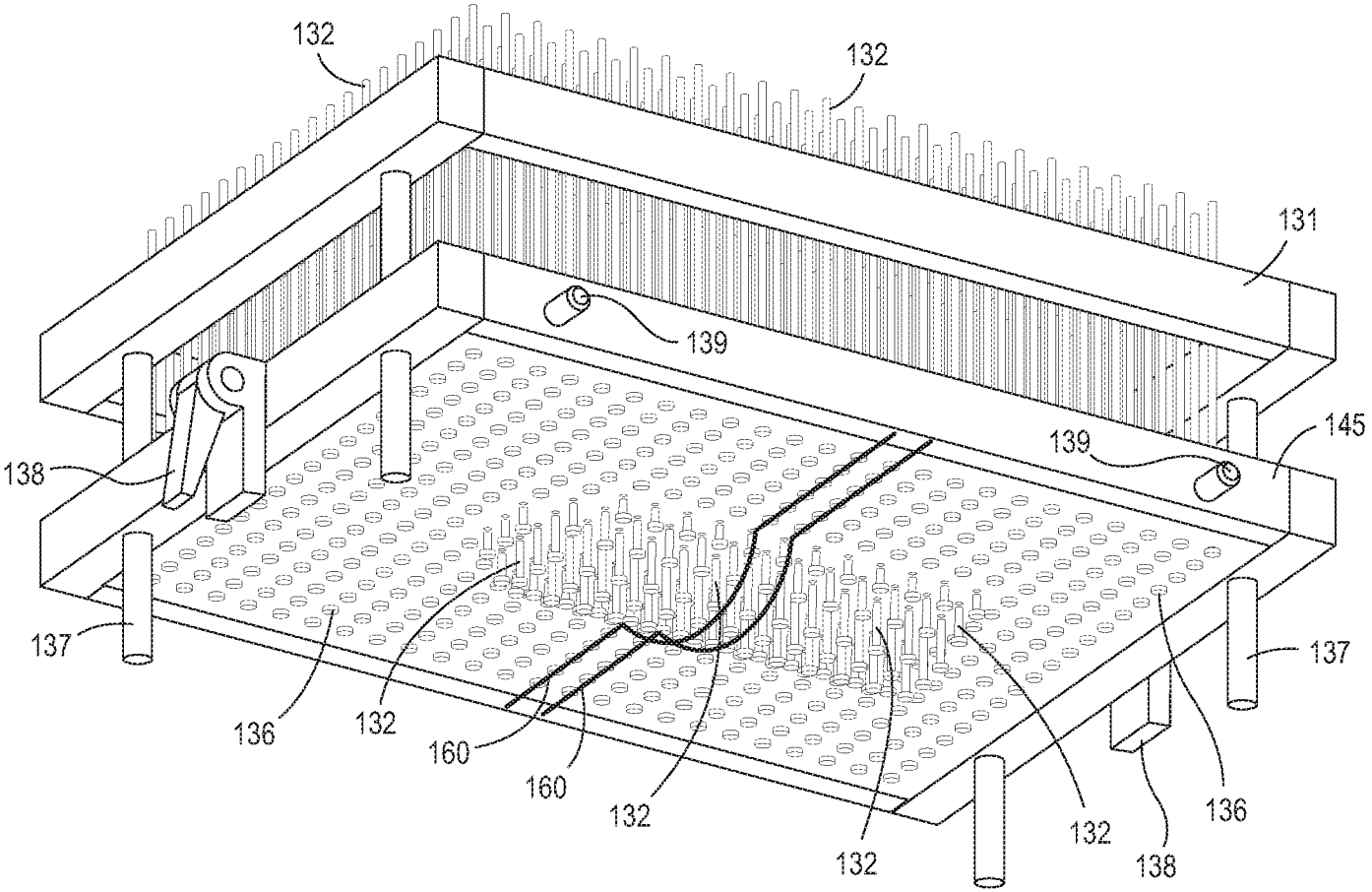
FIGS. 7, 8A, 8B and 8C depict isometric views of pin loading options.
Figure 8A:
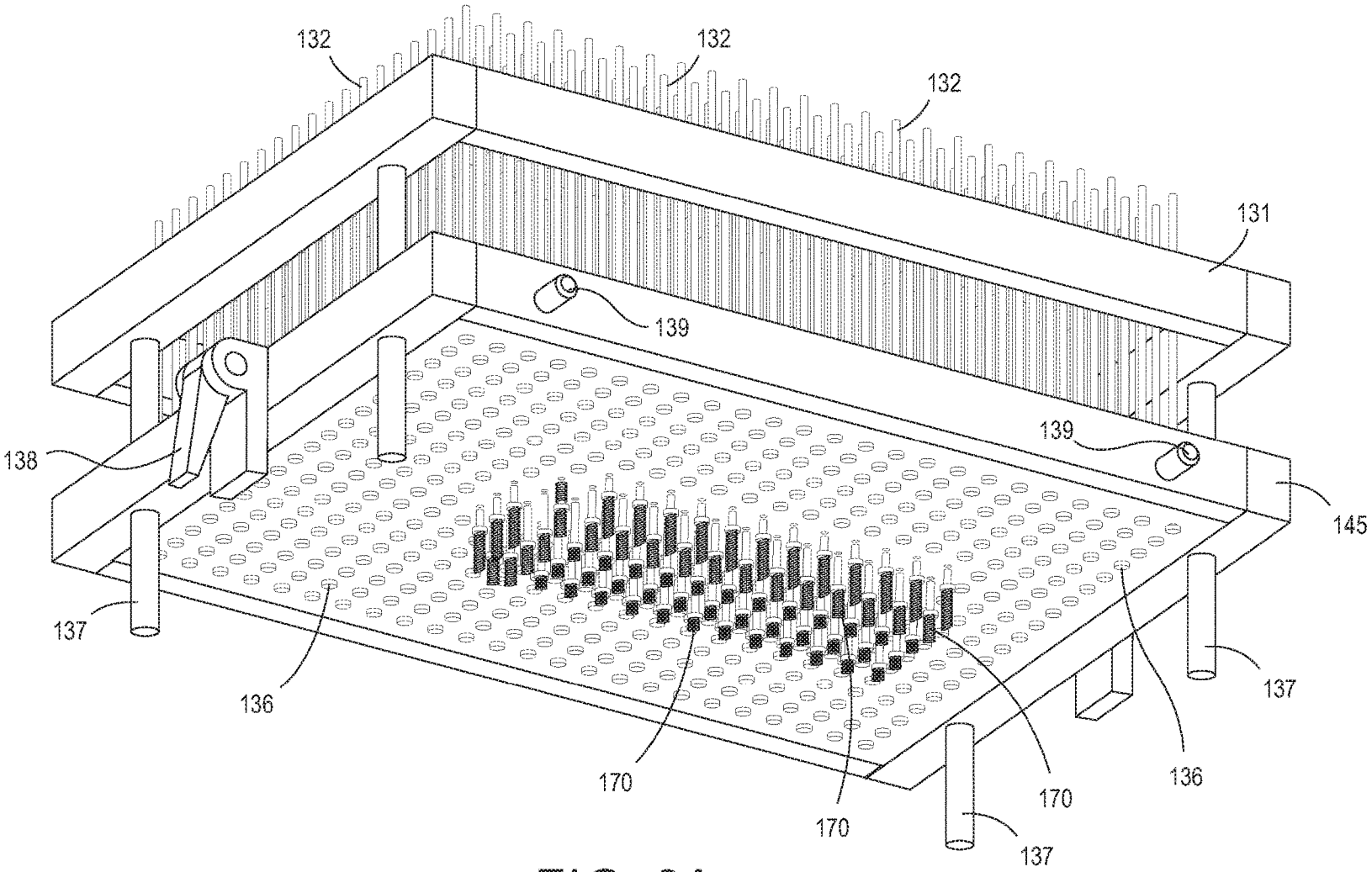
Figure 8B:
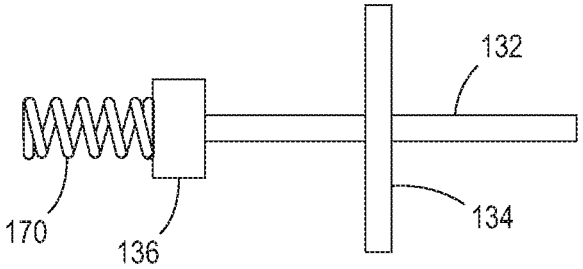
Figure 8C:
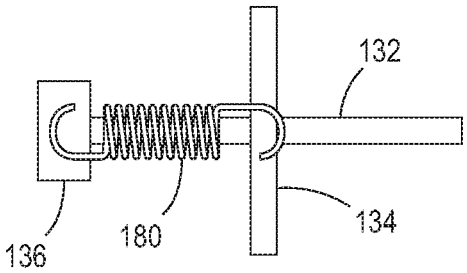

In FIG. 7, loading of contour pins 132 against the weight of objects placed upon datum plate 135 is accomplished with elastic bands 160 that cover heads 136 of pins 132. Each row of pinheads 136 are covered by an elastic band 160 oriented in the cross process direction because objects should have the least amount of topography gradient in this direction for optimal printing since lower tension is created in the elastic bands 160. Pins 132 are biased in a group by elastic bands 160 to protrude a predetermined distance above datum plate 135. Alternative biasing techniques include pins 132 shown in FIGS. 8A and 8B biased by a compression spring 170 and in FIG. 8C by an extension spring 180.

In recapitulation, a universal staging platen is disclosed for precise and repeat positioning of a variety of 3-D object sizes for gripping and presenting to print heads of a 3-D printer includes an array of contour pins biased to protrude a predetermined distance through a datum plate onto which an object is placed. In use, an operator places an object onto the array of pins extending through the datum plate and the object displaces those contour pins that contact the object. Once the object is in place, the array of pins are locked into place by toggle clamps shifting a locking plate and guide plate laterally to hold the object on the datum plate. Thus, another and all other objects of the same type can now be set in place for acquisition by a gripper mechanism without any additional setup or alignment of the objects or image. The object is then picked up by the gripper and moved into position for printing.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A universal apparatus for staging objects and precisely holding the objects prior to removal therefrom by a gripper, comprising:

an upper support frame;

a datum plate connected to said upper support frame;

an array of contour pins positioned to extend above said datum plate;

biasing members for biasing said array of contour pins against the weight of objects placed upon said datum plate; and a clamping plate through which said array of contour pins extend, said clamping plate including compliant fingers, and wherein said compliant fingers include elongated portions that allow the clamping plate to deflect while applying force to said array of contour pins.

2. The universal apparatus of claim 1, wherein said biasing members comprise elastic bands.

3. The universal apparatus of claim 1, wherein-movement of said clamping plate is accomplished with at least one toggle clamp.

4. The universal apparatus of claim 3, including a lower guide plate and guide pins extending vertically through said lower guide plate, said datum plate and said upper support frame.

5. The universal apparatus of claim 4, wherein height of said array of contour pins above said datum plate can be adjusted by sliding said lower guide relative to said datum plate.

6. The universal apparatus of claim 4, wherein said biasing members force pinheads of said array of contour pins against a bottom surface of said lower guide plate.

7. The universal apparatus of claim 3, wherein said at least one toggle clamp is adapted to slide said lower guide plate horizontally with respect to said datum plate to apply a clamping force thereto.

* * * * *